US010001341B2

(12) United States Patent
Geissele

(10) Patent No.: US 10,001,341 B2
(45) Date of Patent: Jun. 19, 2018

(54) FIREARM RAIL AND WEIGHTS

(71) Applicant: WHG Properties, LLC, North Wales, PA (US)

(72) Inventor: William H. Geissele, Lower Gwynedd, PA (US)

(73) Assignee: WHG Properties, LLC, North Wales, PA (US)

( * ) Notice: Subject to any disclaimer, the term of this patent is extended or adjusted under 35 U.S.C. 154(b) by 0 days. days.

(21) Appl. No.: 15/370,031

(22) Filed: Dec. 6, 2016

(65) Prior Publication Data

US 2017/0082396 A1 Mar. 23, 2017

Related U.S. Application Data

(63) Continuation of application No. 14/794,142, filed on Jul. 8, 2015, which is a continuation-in-part of application No. 29/514,838, filed on Jan. 16, 2015, now Pat. No. Des. 759,186, which is a continuation-in-part of application No. 29/514,853, filed on Jan. 16, 2015, now Pat. No. Des. 759,187.

(51) Int. Cl.

| | |
|---|---|
| ***F41C 27/22*** | (2006.01) |
| ***F41C 23/02*** | (2006.01) |
| ***F41C 23/16*** | (2006.01) |

(52) U.S. Cl.

CPC ..... *F41C 27/22* (2013.01); *F41C 23/02* (2013.01); *F41C 23/16* (2013.01)

(58) Field of Classification Search

CPC ..... F41C 27/22; F41C 23/02; F41C 23/16; F41C 23/14; F41C 27/04

USPC ..... 42/96

See application file for complete search history.

(56) References Cited

U.S. PATENT DOCUMENTS

| | | | | |
|---|---|---|---|---|
| 2,140,945 | A | 12/1938 | Swartz | |
| 2,240,681 | A | 5/1941 | Swartz | |
| 2,921,396 | A | 1/1960 | Larson | |
| 3,557,485 | A | 1/1971 | Williams | |
| 3,861,070 | A * | 1/1975 | Wild | F41C 23/02 42/85 |
| 4,571,872 | A | 2/1986 | Johnson | |
| 5,225,615 | A | 7/1993 | Talbot | |
| 5,279,060 | A | 1/1994 | Watson | |
| 5,305,678 | A | 4/1994 | Talbot | |
| 5,343,650 | A * | 9/1994 | Swan | F41C 23/16 42/117 |
| 5,815,974 | A | 10/1998 | Keng | |
| 6,490,822 | B1 | 12/2002 | Swan | |
| RE39,465 | E | 1/2007 | Swan | |
| 7,765,730 | B2 * | 8/2010 | Keng | F41G 1/02 42/111 |
| 8,448,371 | B1 | 5/2013 | Wilhelm | |
| 8,528,246 | B2 * | 9/2013 | Telles | F41C 23/16 42/71.01 |
| 8,726,558 | B1 * | 5/2014 | Nason | F41G 11/003 42/71.01 |

(Continued)

OTHER PUBLICATIONS

Bushmaster Website, Competition Handguard Balance Weight (2013).

*Primary Examiner* — Stephen Johnson

(74) *Attorney, Agent, or Firm* — Fox Rothschild LLP

(57) ABSTRACT

Firearm weights and firearm rails having one or more weights that hug the interior surface of the firearm rail and/or orient a firearm sling loop in an appropriate position on the firearm are disclosed herein.

16 Claims, 7 Drawing Sheets

(56) References Cited

U.S. PATENT DOCUMENTS

| | | | | |
|---|---|---|---|---|
| 8,863,426 | B1 * | 10/2014 | Zinsner | F41C 23/16 42/71.01 |
| 8,904,691 | B1 * | 12/2014 | Kincel | F41C 23/16 42/71.01 |
| 2010/0154280 | A1 * | 6/2010 | LaFrance | F41G 11/001 42/124 |
| 2010/0170133 | A1 * | 7/2010 | Swan | F41C 23/02 42/85 |
| 2015/0135573 | A1 * | 5/2015 | DiChario | F41A 3/66 42/75.02 |

* cited by examiner

FIREARM RAIL AND WEIGHTS

CROSS-REFERENCE TO RELATED APPLICATIONS

This application is a continuation of U.S. patent application Ser. No. 14/794,142 filed Jul. 8, 2015, which is a continuation-in-part of U.S. patent application Ser. No. 29/514,838 filed Jan. 16, 2015 (now U.S. Design Pat. No. D759,186), and a continuation-in-part of U.S. patent application Ser. No. 29/514,853 filed Jan. 16, 2015 (now U.S. Design Pat. No. D759,187). The disclosures of all of the foregoing applications are hereby incorporated by reference in their entireties.

BACKGROUND

Shooting a firearm generates exploding gases that result in a recoil or "kick" of the firearm after each shot. The displacement of the firearm occasioned by recoil can hinder projectile accuracy, particularly during rapid fire in which multiple shots in quick succession create a cumulative recoil effect that tends to cause the firearm to move or "walk" away from the target. Adding weight to the firearm, and especially to certain portions of the firearm, can reduce these negative effects of recoil. Adding weight to a firearm can be particularly advantageous in a situation when the weight of the firearm is not being carried partially or entirely by the shooter, for example in the context of a shooting competition in which the firearm rests on the ground or rests on a structure which, in turn, rests on or is connected to the ground, such as a bipod or tripod. There is a need for firearm weights that are easily installed and removed; firearm weights that are adjustable to a desired weight distribution; and firearm weights that do not expand the profile of the firearm.

Additionally, firearms can be slung over the shooter's shoulder with a sling, the sling being connected to the firearm. Common problems associated with firearm slings include the heft and bulkiness of the mechanism used to attach the sling to the firearm, as well as the difficulty of securing the sling at an appropriate position on the firearm when the firearm is used in shooting competitions.

SUMMARY

In general terms, this disclosure is directed to firearm rails and firearm rail weights.

In one aspect, a firearm weight includes an elongate member having a front end and a rear end, the elongate member configured to be detachably secured to an interior surface of a firearm rail; and a sling loop, the sling loop being pivotably attached to the front end of the elongate member.

In another aspect, a firearm weight system includes a first firearm weight comprising an elongate member having a front end and a rear end, the elongate member configured to be detachably secured to a first portion of an interior surface of a firearm rail, and a sling loop, the sling loop being pivotably attached to the front end of the first firearm weight; a second firearm weight comprising an elongate member having a front end and a rear end, and a flange extending from the elongate member that is configured to be detachably secured to a second portion of the interior surface of the firearm rail; and a third firearm weight comprising an elongate member having a front end and a rear end, and a flange extending from the elongate member that is configured to be detachably secured to a third portion of the interior side of the firearm rail.

In a further aspect, a firearm rail includes an interior surface having at least one longitudinally extending slot; and a weight comprising an elongate member having a front end and a rear end, the elongate member being detachably secured in the at least one slot.

In yet a further aspect, a firearm weight comprises an elongate member having a front end and a rear end; and a flange extending from the elongate member and configured to be detachably secured to an interior surface of a firearm rail.

DETAILED DESCRIPTION

Figure 1:
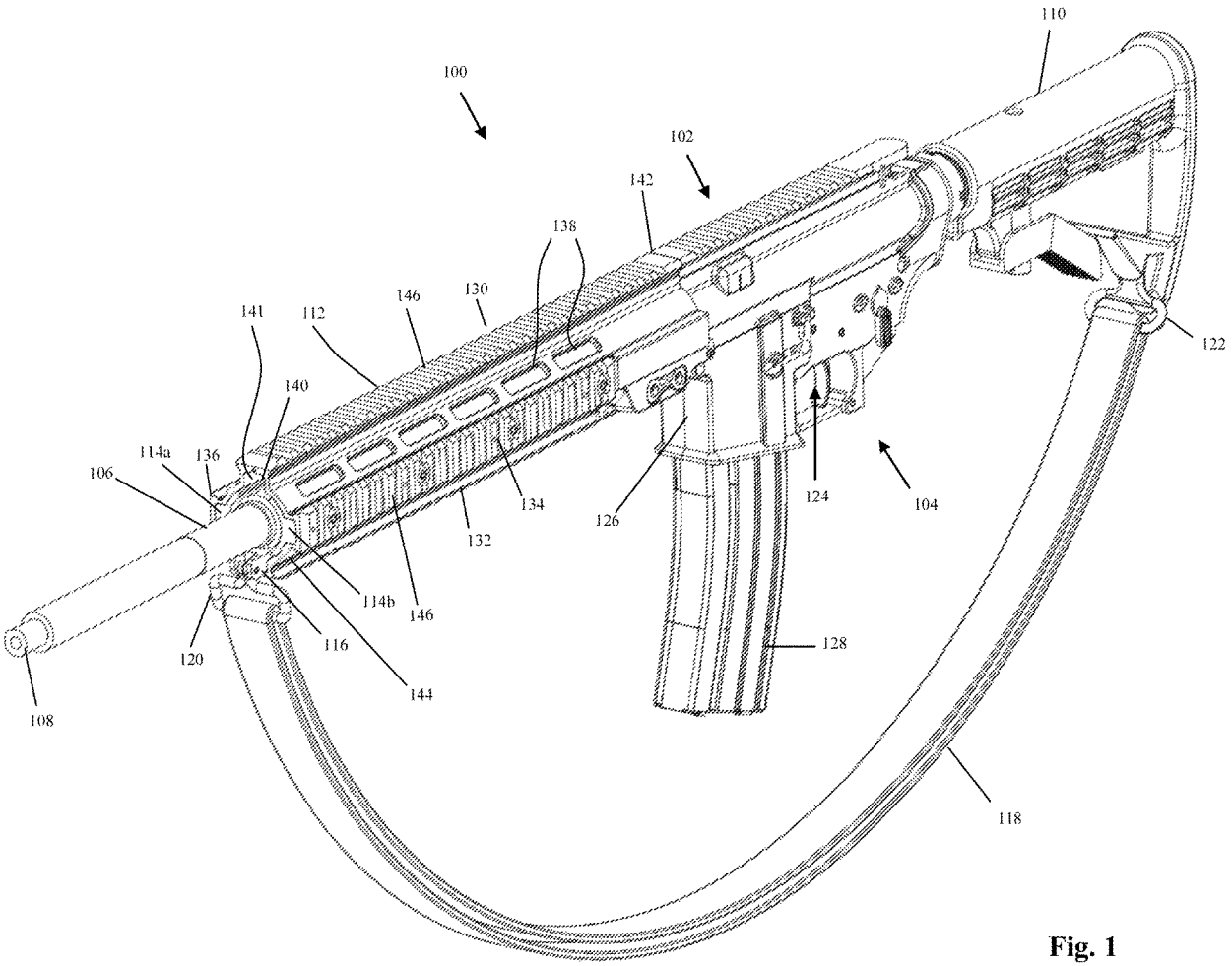
FIG. 1 is a front, top, left side, perspective view of an example firearm with firearm weights consistent with the present disclosure.

Various embodiments are described herein in detail with reference to the drawings, wherein like reference numerals represent like parts and assemblies throughout the several views. Reference to various embodiments does not limit the scope of the appended claims. Additionally, any examples set forth in this specification are not intended to be limiting and merely set forth some of the many possible embodiments for the appended claims.

FIG. 1 is a front, top, left side, perspective view of an example firearm 100 with firearm weights consistent with the present disclosure. In this example, the firearm 100 includes an upper receiver 102, a lower receiver 104, a barrel 106, a muzzle 108, a stock 110, a rail 112, side weights 114*a* and 114*b*, a bottom weight 116, a sling 118, a front sling loop 120, and a rear sling loop 122. The lower receiver 104 includes a trigger mechanism 124, a magazine well 126, and a magazine 128. The rail 112 includes a top side 130, a bottom side 132, a left side 134, a right side 136, heat vents 138, an interior surface 140, an interior bore 141, a rear end 142, and a front end 144. Each of the top side 130, the bottom side 132, the left side 134, and the right side 136 of the rail 112 includes mounting ribs 146.

The firearm 100 can be of a variety of types. Examples of the firearm 100 include, but are not limited to, handguns, rifles, shotguns, carbines, machine guns, submachine guns, personal defense weapons, automatic rifles, and assault rifles. In at least one embodiment, the firearm 100 is an AR-15, M-16 or M-4 type rifle, or one of their variants.

The upper receiver 102 defines an internal longitudinally-extending cavity configured to receive a bolt assembly. The bolt assembly is slidably disposed in the cavity for axially reciprocating recoil movement therein. In at least one embodiment, the upper receiver 102 is an AR-15, M-16 or M-4 type upper receiver, or one of their variants.

The lower receiver 104 is situated below the upper receiver 102 and is involved in triggering the firearm 100. The barrel 106 includes an internal, longitudinally extending bore that ends at the muzzle 108 at the front of firearm 100, where a projectile (e.g., a bullet) exits the firearm. The barrel 106 is in open communication with the upper receiver 102.

The upper receiver 102 and the lower receiver 104 are configured to house a firing mechanism and associated components as found in, for example, AR-15, M-16 or M-4 type rifles and their variants. Such a firing mechanism typically includes a spring-biased hammer that is cocked and then released by a sear upon actuating a triggering mechanism. The hammer strikes a firing pin carried by a bolt, which in turn is thrust forward to contact and discharge a cartridge loaded in a chamber. A portion of the expanding combustion gases traveling down the barrel is discharged off and used to drive the bolt rearward against a forward biasing force of a recoil spring for automatically ejecting the spent cartridge casing and automatically loading a new cartridge into the chamber from a magazine when the bolt returns forward.

The stock 110 surrounds a buffer tube extending from the rear of upper receiver 102. Buffer tubes typically include a buffer pin, a buffer spring for recoil reduction, as well as a castle nut and an endplate. The stock 110 provides support to the operator holding the firearm 100 to steady and aim the firearm 100 during firing. The stock 110 also operates to transmit recoil generated from firing the firearm to the body of the shooter.

The rail 112 surrounds at least a portion of barrel 106. The rail 112 can be used as a place to hold the front portion of the firearm 100 during use, and can function as a guard to protect the firearm user's hand from the heat of the barrel 106 while shooting the firearm. In addition, the rail 112 can function as a mounting platform for firearm accessories, such as a bipod, tripod, light, hand grip, sight, optic, optic platform, infrared laser, magnifier, and so forth.

The example side weights 114*a* and 114*b* are detachably secured inside the rail 112 and provide weight to the firearm 100. The side weights 114*a* and 114*b* can shift the center of gravity of the firearm 100, and can help to reduce the negative effects of recoil generated from firing the firearm 100. The bottom weight 116 is also detachably secured inside the rail 112 and provides weight to the firearm 100. The bottom weight 116 can also shift the center of gravity of the firearm 100, and can help to reduce the negative effects of recoil generated from firing the firearm 100.

The sling 118 is a looped strap that can be slung over the shooter's shoulder when carrying or using the firearm 100 in order to help steady the firearm 100 and/or transfer some of the firearm's weight to the user's shoulder. The example sling 118 attaches to the firearm 100 by looping through the front sling loop 120 and the rear sling loop 122. In this example, the front sling loop 120 is pivotably coupled to the bottom weight 116, and the rear sling loop 122 is coupled to the stock 110. In this manner, the weight of the sling 118 hangs from the bottom weight 116 and the stock 110.

The trigger mechanism 124 of the lower receiver 104 operates the trigger of the firearm 100. The magazine well 126 in the lower receiver 104 houses the magazine 128, which in turn holds projectiles for shooting from the firearm 100.

The example rail 112 includes four sides—a top side 130, a bottom side 132, a left side 134, and a right side 136. Among these four sides, adjacent sides are spaced apart from each other and equidistant (i.e. at 90° angles) from each other. In this example, the rail 112 is secured to a barrel nut (see discussion below in connection with FIG. 12), which in turn secures the barrel 106 to the upper receiver 102. The heat vents 138 are openings that line the spaces between each adjacent pairs of the four sides 130, 132, 134, and 136. The heat vents 138 allow heat radiating from the barrel 106 as a result of shooting the firearm 100 to escape, thereby preventing excessive heat build-up between the rail 112 and the barrel 106. The interior surface 140 of the rail 112 surrounds the interior bore 141. The interior bore 141 of the rail 112 extends from the rear end 142 to the front end 144 of the rail 112. In this example, the rear end 142 of the rail 112 abuts the upper receiver 102, and the barrel 106 extends through the entirety of interior bore 141 and beyond the front end 144 of the rail 112. In this example, the mounting ribs 146 alternate with grooves and line each of the four sides 130, 132, 134, and 136 of the rail 112. The mounting ribs 146 with their corresponding grooves provide a platform for mounting firearm accessories having corresponding ribs and grooves that engage the grooves and mounting ribs 146, respectively, of rail 112. Example accessories that can be mounted in this manner to the rail 112 include, without limitation, a bipod, tripod, light, hand grip, sight, optic, optic platform, infrared laser, and magnifier. In one example, the mounting ribs 146 are standard dimension such as a "Picatinny" style mounting platform, also known as MIL-STD-1913.

Figure 2:
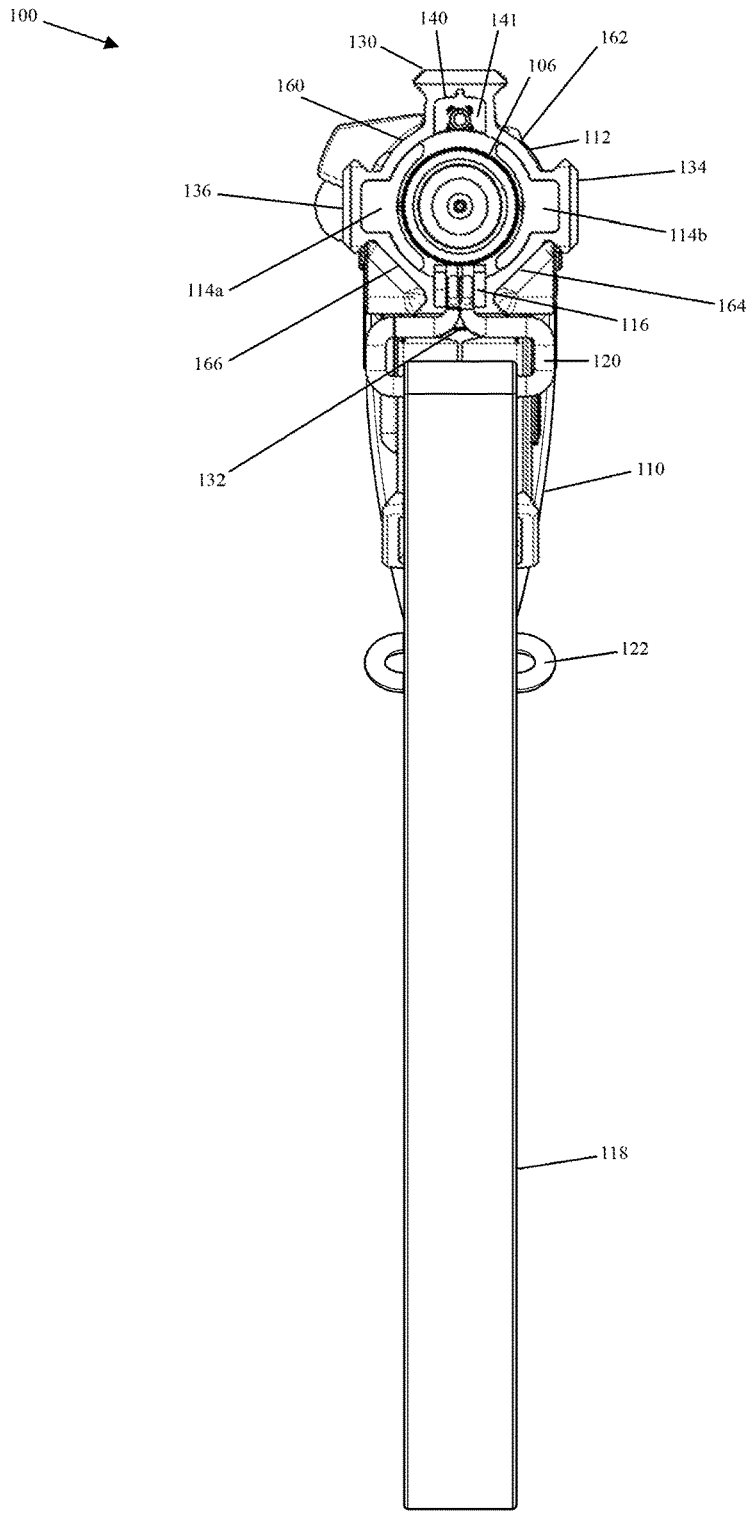
FIG. 2 is a front view of the example firearm of FIG. 1 with firearm weights consistent with the present disclosure.

FIG. 2 is a front view of the example firearm 100 of FIG. 1 with firearm weights consistent with the present disclosure. The firearm 100 includes the barrel 106, the stock 110, the rail 112, the side weights 114*a* and 114*b*, the bottom weight 116, the sling 118, the front sling loop 120, and the rear sling loop 122 as discussed above. In addition, the rail 112 includes the top side 130, the bottom side 132, the left side 134, the right side 136, the interior surface 140, and the interior bore 141 as discussed above. In addition, in this example, the rail 112 includes a top right side 160, a top left side 162, a bottom left side 164, and a bottom right side 166.

In this example firearm 100, the top right side 160 of the example rail 112 is recessed between the top side 130 and the right side 132 of the rail 112. The top left side 162 is recessed between the top side 130 and the left side 134 of the rail 112. The bottom left side 164 is recessed between the bottom side 132 and the left side 134 of the rail 112. The bottom right side 166 is recessed between the bottom side 132 and the right side 136 of the rail 112. In this example rail 112, heat vents (such as the heat vents 138 discussed above in connection with FIG. 1) are lined along each of the top right side 160, the top left side 162, the bottom left side 164, and the bottom right side 166 of the rail 112.

As also shown in FIG. 2, in this example firearm 100, the side weight 114*a* is inside the interior bore 141 and abuts the interior surface 140 of the rail 112 on the right side of the barrel 106, and the side weight 114*b* is inside interior bore 141 and abuts the interior surface 140 of the rail 112 along the left side of the barrel 106. In addition, the bottom weight 116 is inside the interior bore 141 and abuts the interior surface 140 of the rail 112 below the barrel 106. Installing the side weights 114*a* and 114*b* and the bottom weight 116 within the rail 112 avoids expanding the exterior profile of the firearm 100 as compared with, e.g., mounting or installing a firearm weight to the exterior of a firearm or a firearm component. Reducing the extent of a firearm's profile can improve the appearance of the firearm and also help to avoid undesirable snagging of the firearm while carrying it.

Figure 3:
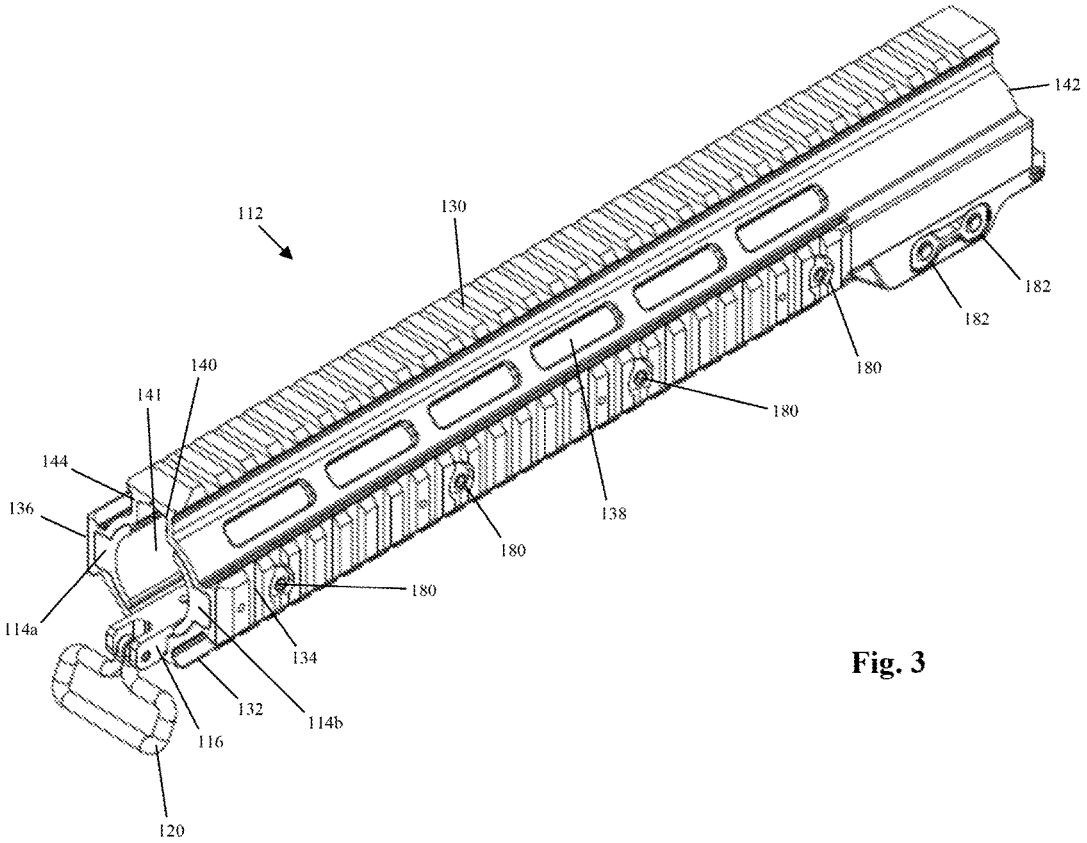
FIG. 3 is a front, top, left side perspective view of an example firearm rail with firearm weights consistent with the present disclosure.

FIG. 3 is a front, top, left side perspective view of an example firearm rail 112 with firearm weights consistent with the present disclosure. The example rail 112 includes the top side 130, the bottom side 132, the left side 134, the right side 136, the heat vents 138, the interior surface 140, the interior bore 141, the rear end 142, the front end 144, and the mounting ribs 146 as discussed above. The side weights 114*a* and 114*b*, and the bottom weight 116 including the front sling loop 120, as discussed above, are also shown. In addition, in this example the rail/weights combination includes side weight fasteners 180, and barrel nut fasteners 182.

The side weight fasteners 180 secure the side weight 114*b* to the interior surface 140 of the rail 112. A corresponding set of side weight fasteners (not shown) secures the side weight 114*a* to the interior surface 140 of the rail 112. In one example, the side weight fasteners 180 are screws that are inserted into openings in the left side 134 and the right side 136 of the rail 112 and then enter threaded openings in the side weights 114*a* and 114*b* respectively. In this example, the openings in the rail used for this purpose are drilled between adjacent pairs of mounting ribs 146 on the left side 134 and the right side 136, respectively, of the rail 112. In one example, opposing inner sides of the aforementioned adjacent pairs of mounting ribs are carved out to accommodate a fastener head that may be larger than the opening through which the fastener is inserted. This allows the fastener head to abut the bottom surface of the groove between the pair of adjacent mounting ribs 146, which in turn provides a more secure interface between the side weight 114*a* or 114*b* and the interior surface 140 of the rail 112.

The barrel nut fasteners 182 secure the rail 112 to a barrel nut (not shown) at the rear end of a firearm barrel. In one example, the barrel nut fasteners 182 are a dual bolt and nut mechanism consisting of a pair of bolts extending through the width of the rail 112 from the right side 136 to the left side 134, with each of a pair of nuts securing each of the bolts in place, respectively. In this example, as the bolts pass through the rail 112, they engage grooves in a barrel nut (as discussed below in more detail in connection with FIG. 12), thereby preventing movement of the rail relative to the barrel nut and barrel.

Figure 4:
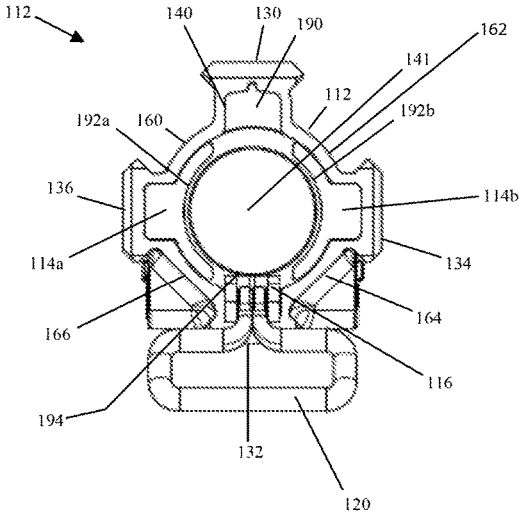
FIG. 4 is a front view of the firearm rail and weights combination of FIG. 3.

FIG. 4 is a front view of the firearm rail and weights combination of FIG. 3. The combination includes the firearm rail 112, the side weights 114*a* and 114*b*, and the bottom weight 116 including the front sling loop 120, as discussed above. The rail 112 includes the top side 130, the bottom side 132, the left side 134, the right side 136, the interior surface 140, the interior bore 141, the top right side 160, the top left side 162, the bottom left side 164, and the bottom right side 166, as also discussed above. In this example, the interior bore 141 of the rail 112 also includes an upper channel 190; the side weight 114*a* includes an interiorly facing curved surface 192*a*; the side weight 114*b* includes an interiorly facing curved surface 192*b*; and the bottom weight 116 includes a top surface 194.

In this example firearm rail and weights combination, the upper channel 190 is an extension of the interior bore 141 and is situated directly below the upper side 130 of the rail 112. Typically, the upper channel 190 is used to accommodate firearm barrel attachments, such as a gas tube (which operates to divert some of the gases generated from a fired projectile back into a firearm upper receiver to assist in cycling the firearm for repeated firing), that are positioned on top of a barrel (such as the barrel 106 in FIG. 2).

When a barrel of a firearm (such as barrel 106 in FIGS. 1-2) is housed in the rail/weights combination of FIG. 4, the interiorly facing curved surface 192*a* of the side weight 114*a* follows the contour of the barrel's exterior surface on the barrel's right side, the interiorly facing curved surface 192*b* of the side weight 114*b* follows the contour of the barrel's exterior surface on the barrel's left side, and the top surface 194 of the bottom weight 116 faces the bottom of the barrel's exterior surface. This allows sufficient empty space in the interior bore 141 of the rail 112 for the rail 112 to house the barrel 106. In some example embodiments, at least a portion of one or more of the interiorly facing curved surfaces 192*a* and 192*b* and top surface 194 abuts the exterior of the barrel. In other example embodiments, there is no contact between one or more of the side weights 114*a* and 114*b* and the bottom weight 116, on the one hand, and the barrel on the other hand, such that a gap of air separates one or more of the weights from the barrel.

Figure 5:
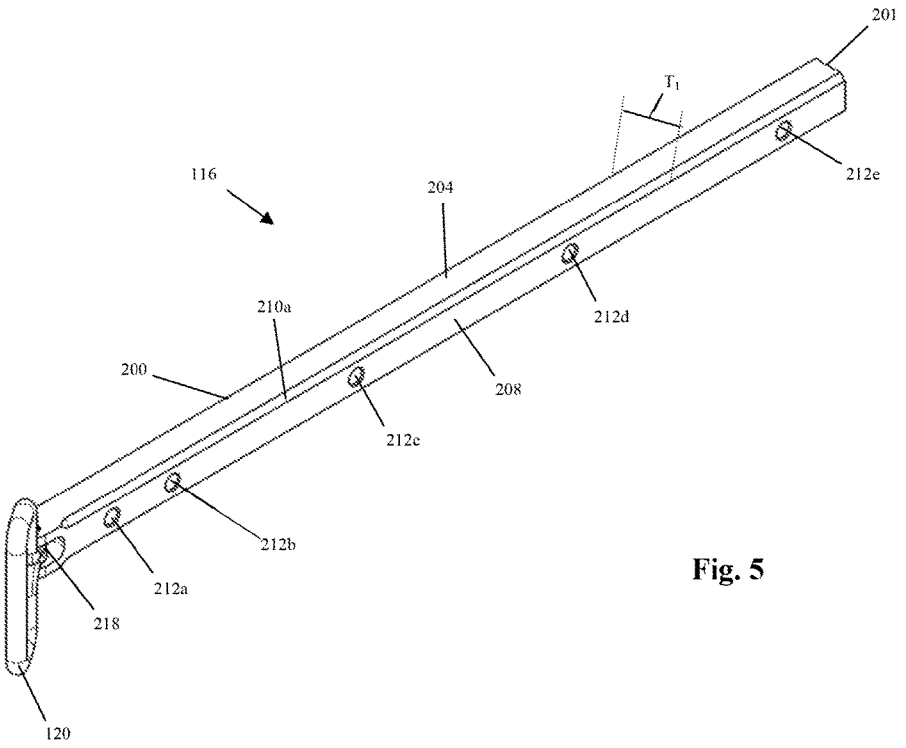
FIG. 5. is a front, bottom, left side perspective view of a combination of an example bottom weight for a firearm rail and a sling loop in accordance with the present disclosure.
Figure 6:
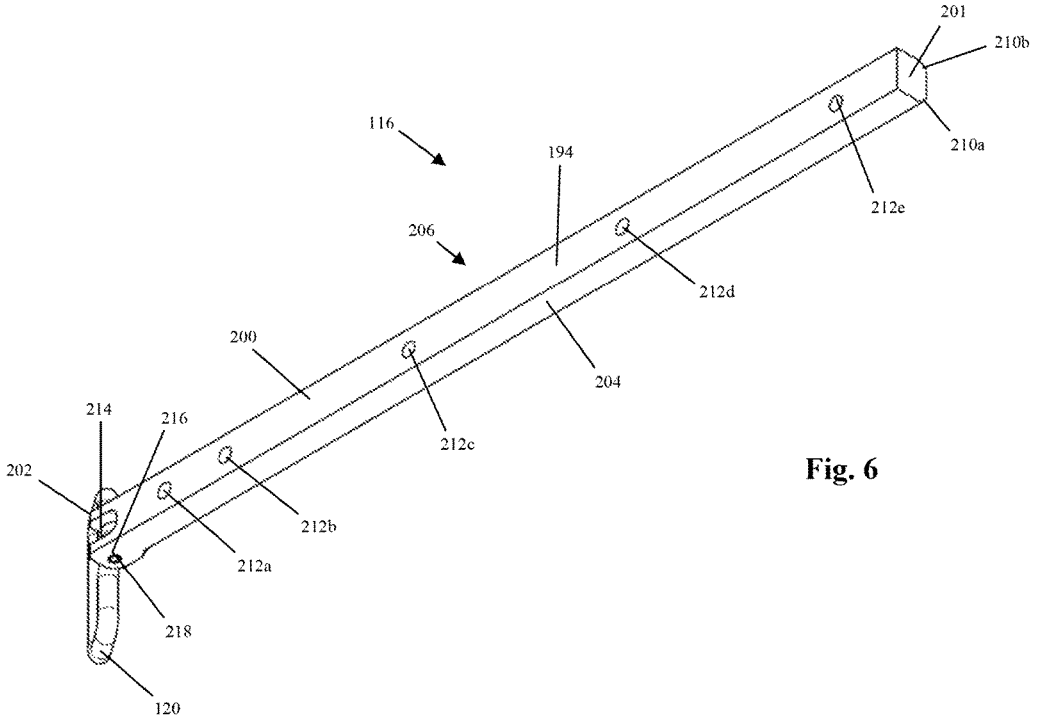
FIG. 6 is a rear, top, left side perspective view of the combination bottom weight and sling loop of FIG. 5.

FIG. 5. is a front, bottom, left side perspective view of a combination of an example bottom weight 116 for a firearm rail 112 and a sling loop 120 in accordance with the present disclosure; FIG. 6 is a rear, top, left side perspective view of the combination bottom weight 116 and sling loop 120 of FIG. 5. FIGS. 5 and 6 show example bottom weight 116, front sling loop 120, and top surface 194 as discussed above. In addition, in this example, the bottom weight 116 includes an elongate member 200, a rear end 201, a front end 202, a left surface 204, a right surface 206, a bottom surface 208, chamfers 210*a* and 210*b*, screw holes 212*a*, 212*b*, 212*c*, 212*d*, and 212*e*, a cutout 214 and a pin hole 216. Additionally in this example, the front sling loop 120 includes a sleeve 218, and a pin 220.

The elongate member 200 of the example bottom weight 116 is configured to be inserted into and housed in a slot at the bottom of a firearm rail. In some embodiments, the elongate member 200 is made from a relatively dense material to provide weight and strength to the rail in which it is housed and to which it is secured. In on example, the elongate member 200 is steel. The elongate member 200 has a thickness $T_1$ as measured between the bottom surface 208 and the top surface 194. $T_1$ can be a variety of suitable thicknesses. In some examples, $T_1$ is in a range from about 5 mm to about 15 mm. In one example embodiment, $T_1$ is about 9 mm. In some examples $T_1$ corresponds to the distance between a deepest surface of the bottom slot 272 (see FIG. 12) in the rail 112 (see FIG. 12) and the exterior surface of a barrel (e.g. the barrel 106 in FIG. 1) that is inserted in the rail 112.

The example bottom weight 116 is cast or otherwise shaped from metal or a metal alloy, such as steel. In one example embodiment of the bottom weight 116, all features of the bottom weight are cast together in a single mold. In alternative embodiments, one or more features of the bottom weight 116 are machined from barstock or following the casting process, such as the chamfers 210*a* and 210*b*, the screw holes 212*a*, 212*b*, 212*c*, 212*d*, and 212*e*, the cutout 214 and/or the pin hole 216. In alternative examples, other suitably heavy, strong, and rigid materials may be used for the bottom weight 116.

In one example configuration, the bottom weight 116 is inserted into a rail from its rear end 201 first. When fully inserted in the rail, the front end 202 of the bottom weight 116 protrudes somewhat from the front of the rail (such as rail 112 in FIG. 3). In addition, when fully inserted in the rail, the left surface 204, the right surface 206, the bottom surface 208, and the chamfers 210*a* and 210*b* abut corresponding surfaces in a slot at the bottom of the firearm rail, as discussed in more detail below in connection with FIG. 12. The chamfers 210*a* and 210*b* avoid sharp angles that may cause damage to either the firearm rail or the bottom weight 116 when the bottom weight 116 is inserted in the rail. In one example embodiment, when fully inserted in the rail, the section of the elongate member 200 between the front end 202 and the chamfers 210*a* and 210*b* protrudes beyond the front end of the rail. In addition, when fully inserted in the rail, the screw holes 212*a*, 212*b*, 212*c*, 212*d*, and 212*e* align with corresponding holes in the bottom of the rail, such that screws or other suitable fastening means can be inserted through the bottom of the rail and into the bottom weight to secure the bottom weight 116 to the bottom of the rail. In example alternative embodiments, the screw holes 212*a*, 212*b*, 212*c*, 212*d*, and 212*e* are not threaded and can receive alternative fasteners such as pins or pegs. In further alternative embodiments, the screw holes 212*a*, 212*b*, 212*c*, 212*d*, and 212*e* can be replaced with protrusions that function as the male aspect of a male-female connection with corresponding female aspects of the firearm rail.

The cutout 214 at the front end 202 of the bottom weight 116 accommodates the front sling loop 120. More specifically, the pin hole 216, which extends through both sides of the cutout 214 houses a pin 220. Between the two sides of the cutout 214, the pin 220 also extends through the sleeve 218 of the front sling loop 120. In this manner, the pin 220 couples the bottom weight 116 to the front sling loop 120 in a pivotable fashion, allowing the front sling loop 120 to pivot around the pin 220. By pivoting the front sling loop 120, a firearm user can adjust the sling attached to the front sling loop 120 without adjusting the firearm. In one example embodiment, the pin 220 consists of two protrusions that are integrally cast or machined to both open ends of the sleeve 218 such that the protrusions mate with the pin hole 216 on both sides of the cutout 214. In another example embodiment, the pin 220 is a discrete component that can be inserted through the pin hole 216 and the sleeve 218.

Coupling the front sling loop 120 to the bottom weight 116 avoids the need to attach a sling loop to a firearm rail itself. Attaching a sling loop to a rail can require a bulky connection platform that juts out from the side of the firearm rail and mates on one side with the bottom of the rail and on the other side with the sling loop. Thus, coupling the front sling loop 120 to the bottom weight 116 can provide a firearm with smaller and more discreet profile, fewer accessories that may tend to interfere with operation or transport of the firearm, and/or precise positioning of the sling loop for shooting competitions.

As discussed above, the bottom weight 116 provides weight to a firearm and firearm rail, as well as strength and stability to a firearm rail. The mass $M_1$ of bottom weight 116 can be of a variety of values. In some embodiments, $M_1$ is in a range from about 100 g to about 400 g. In one example, $M_1$ is about 220 g. $M_1$ can also fall outside of this range. The elongate member 200 of the bottom weight 116 is also adjustable in length and thereby adjustable in weight. For example the elongate member 200 can be shortened by chopping off (e.g., with a hacksaw) a portion between the screw hole 212*e* and the rear end 201; or a section between the screw hole 212*d* and the rear end 201; or a section between the screw hole 212*c* and the rear end 201; or a section between the screw hole 212*b* and the rear end 201; or a section in the middle of the elongate member 200, leaving portions of the weight on either side. Installing a shortened bottom weight in a firearm rail or multiple segments of a shortened bottom weight in this manner allows for variation in weight and weight distribution of the firearm rail and overall firearm according the user's desires and specifications.

As discussed below in more detail in connection with FIG. 9, in one example embodiment of the bottom weight 116, the screw holes 212*a* and 212*b* are positioned on the elongate member 200 such that, when installed in a firearm rail that is itself secured to a firearm, the front sling loop 120 is properly positioned for a firearm shooting competition.

Figures 7, 8:
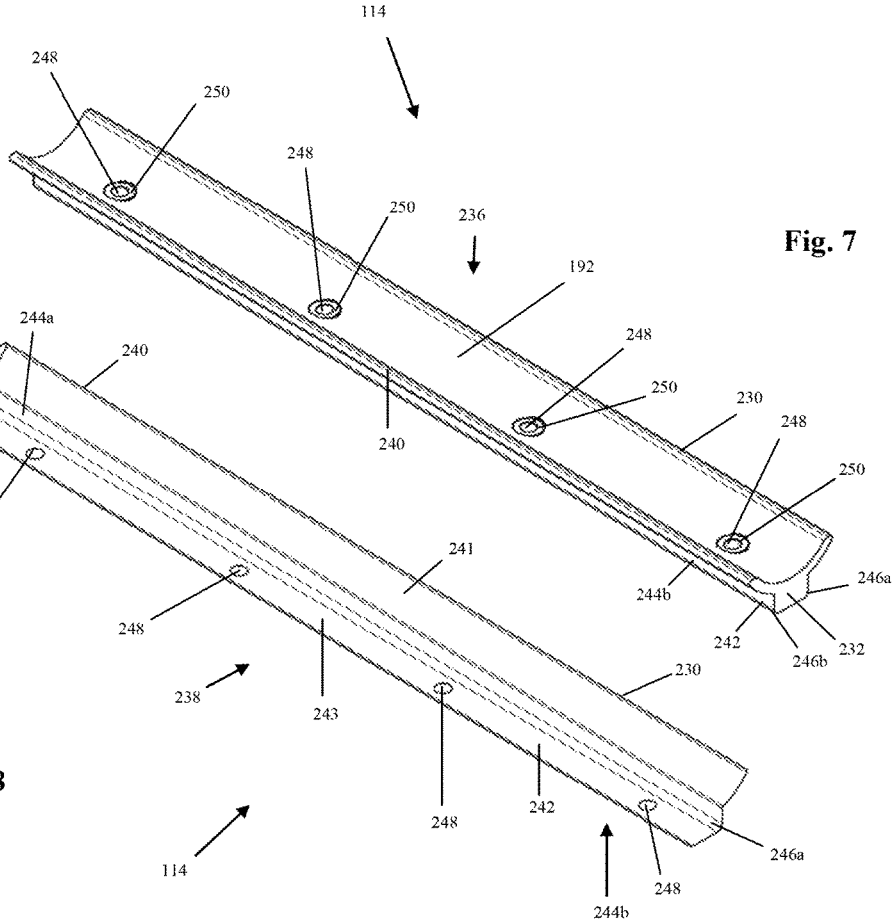
FIG. 7 is a front, top perspective view of an example side weight for a firearm rail in accordance with the present disclosure.
FIG. 8 is a rear, bottom, perspective view of the side weight of FIG. 7.

FIG. 7 is a front, top perspective view of an example side weight for a firearm rail in accordance with the present disclosure; FIG. 8 is a rear, bottom, perspective view of the side weight of FIG. 7. FIGS. 7 and 8 show the example side weight 114 having the interiorly facing curved surface 192, as discussed above. The side weight 114 can equivalently correspond to either side weight 114*a* or 114*b* discussed above in connection with FIGS. 1-4. Likewise, the interiorly facing curved surface 192 equivalently corresponds to either interiorly facing curved surface 192*a* or 192*b* discussed above in connection with FIG. 4. In addition, in this example, the side weight 114 includes an elongate member 230, a front end 232, a rear end 234, a top 236, a bottom 238, an arcuate portion 240 having a bottom surface 241, a flange 242 having a bottom surface 243, side surfaces 244*a* and 244*b* and chamfers 246*a* and 246*b*, holes 248, and threaded rings 250.

The elongate member 230 of the example side weight 114 is configured to be inserted into and housed in a slot at the side of a firearm rail. In some embodiments, the elongate member 230 is made from a relatively dense material to provide weight and strength to the firearm rail in which it is housed and to which it is secured, as well as to provide weight to the overall firearm.

The example side weight 114 is symmetrical, such that the side weight 114 can be equivalently inserted into a rail from its front end 232 or its rear end 234 first. In one example embodiment, when fully inserted in the rail, the front end 232 (or the rear end 234) of the side weight 114 is flush with the front of the rail (such as the rail 112 in FIG. 3). In addition, when fully inserted in the rail, the bottom surface 241 of the arcuate portion 240, and the bottom surface 243, side surfaces 244*a* and 244*b*, and the chamfers 246*a* and 246*b* of the flange 242 abut corresponding surfaces in a slot at the side of the firearm rail, as discussed in more detail below in connection with FIG. 12. The chamfers 246*a* and 246*b* avoid sharp angles that may cause damage to either the firearm rail or the side weight 114 when the side weight 114 is inserted in the rail. In one example embodiment, when fully inserted in the rail, the holes 248 align with corresponding holes in the side of the rail, such that screws or other suitable fastening means can be inserted through the side of the rail and into the side weight to secure the side weight 114 to the side of the rail. In this example, the threaded rings 250 are in open contact with the holes 248 respectively. The threaded rings 250 provide a female counterpart for screws inserted through the rail and the side weight 114 used for securing the side weight 114 to the rail. In one example the threaded rings 250 are made of metal such as steel that does not shear or erode when the screws are threaded therein. This prevents the holes 248 from shearing or eroding from threading screws therein, particularly if the elongate member 230 of side weight 114 consists of a malleable or erodible material such as lead. In example alternative embodiments, there are no threaded rings and the holes 248 can receive alternative fasteners such as pins or pegs. In further alternative embodiments, the holes 248 can be replaced with protrusions that function as the male aspect of a male-female connection with corresponding female aspects of the firearm rail.

The example side weight 114 is cast or otherwise shaped from metal or a metal alloy, such as lead. In alternative examples, other suitably heavy, strong and rigid materials may be used for the side weight 114. In one example embodiment of the side weight, all features of the side weight are cast together in a single mold. In alternative embodiments, one or more features of the side weight 114 are machined following the casting process, such as the chamfers 246*a* and 246*b*, the holes 248, and the threaded rings 250. In further alternative examples, the threaded rings 250 constitute a different material than the rest of side weight 114 as discussed below, and are cast separately and installed in the holes 248, respectively, after the elongate member 230 and has been cast.

As discussed above, the side weight 114 provides weight to a firearm and firearm rail, as well as strength and stability to a firearm rail. The mass $M_2$ of the side weight 114 can be a variety of suitable values. In some embodiments, $M_2$ is in a range from about 100 g to about 800 g. In one example, $M_2$ is about 424 g. $M_2$ can also fall outside of this range. The elongate member 230 of the side weight 114 is also adjustable in length and thereby adjustable in weight. For example, the elongate member 200 can be shortened by chopping off (e.g., with a hacksaw) a portion between any one of the holes 248 and the front end 232; or a section in the middle of elongate member 200, leaving portions of the weight on either side. Installing one or more shortened side weights or multiple segments of one or more shortened side weights in a firearm rail in this manner allows for variation in weight and weight distribution of the firearm rail and overall firearm according the user's desires and specifications. For example, two side weights of different lengths, or two side weights of equally shortened lengths, can be installed in the same rail to vary the firearm's weight and weight distribution.

Figure 9:
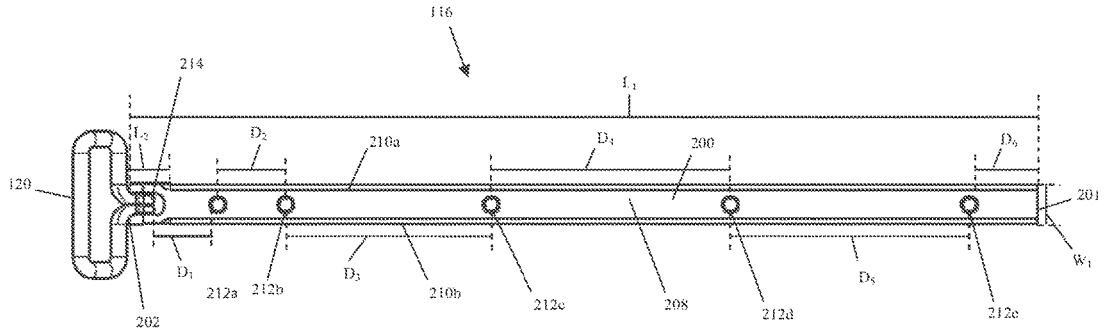
FIG. 9 is a bottom view of a combination of the example bottom weight for a firearm rail and a sling loop of FIG. 5.

FIG. 9 is a bottom view of a combination of the example bottom weight for a firearm rail and a sling loop of FIG. 5. The example bottom weight 116 includes the elongate member 200, the rear end 201, the front end 202, the bottom surface 208, the chamfers 210*a* and 210*b*, the screw holes 212*a*, 212*b*, 212*c*, 212*d*, and 212*e*, and the cutout 214, as discussed above. The front sling loop 120 is also shown in FIG. 9, as discussed above.

The elongate member 200 has a length $L_1$ as measured between the front end 202 and the rear end 201. $L_1$ can be a variety of suitable lengths. In some examples, $L_1$ is in a range from about 25 mm to about 400 mm. In one example embodiment, $L_1$ is about 265 mm. Cutout 214 has a length $L_2$ as measured between the front end 202 of bottom weight 116 and chamfers 210*a* and 201*b*. $L_2$ can be a variety of suitable lengths. In some examples, $L_2$ is in a range from about 3 mm to about 50 mm. In one example embodiment, $L_2$ is about 10 mm. In an alternative embodiment, bottom weight 116 does not have a cutout, and the front sling loop 120 is attached to the firearm by another suitable means.

The example elongate member 200 has a width $W_1$. $W_1$ can be a variety of suitable lengths. In some examples $W_1$ is in a range from about 5 mm to about 25 mm. In one example embodiment, $W_1$ is about 12 mm.

The screw holes 212*a*, 212*b*, 212*c*, 212*d*, and 212*e* can be distributed along the elongate member 200 to match up with corresponding holes in a firearm rail for securing the bottom weight 116 to the firearm rail.

In the example combination of the bottom weight 116 and the front sling loop 120, there is a distance $D_1$ as measured between the rearmost point of the front sling loop 120 and the front most point of the screw hole 212*a*. $D_1$ can be in a variety of suitable lengths. In some examples, $D_1$ is in a range from 0 mm to about 40 mm. In one example embodiment, $D_1$ is about 17 mm. In the example bottom weight 116 there is also a distance $D_2$ between corresponding locations on screw hole 212*a* and the screw hole 212*b* along the bottom surface 208. $D_2$ can be a variety of suitable lengths. In some examples, $D_2$ is in a range from about 5 mm to about 40 mm. In one example embodiment, $D_2$ is about 20 mm. In some embodiments, $D_1$ and $D_2$ are such that, upon installation of the bottom weight 116, or any portion thereof that includes at a least screw hole 212*a*, the front sling loop 120 is disposed in a position relative to the firearm that is suitable for shooting competitions, as discussed above.

The distance $D_3$ along the bottom side 208 between corresponding locations on the screw hole 212*b* and the screw hole 212*c* can be a variety of suitable lengths. In some example embodiments, $D_3$ is in a range from about 5 mm to about 100 mm. In one example, $D_3$ is about 60 mm.

The distance $D_4$ along bottom side 208 between corresponding locations on the screw hole 212*c* and the screw hole 212*d* can be a variety of suitable lengths. In some example embodiments, $D_4$ is in a range from about 5 mm to about 100 mm. In one example, $D_4$ is about 70 mm.

The distance $D_5$ along bottom side 208 between corresponding locations on the screw hole 212*d* and the screw hole 212*e* can be a variety of suitable lengths. In some example embodiments, $D_5$ is in a range from about 5 mm to about 100 mm. In one example, $D_5$ is about 70 mm.

The distance $D_6$ along the bottom side 208 between the rearmost point of the screw hole 212*e* and the rear end 201 of the elongate member 200 can be a variety of suitable lengths. In some example embodiments, $D_6$ is in a range from about 1 mm to about 40 mm. In one example, $D_6$ is about 18 mm.

Figure 10:
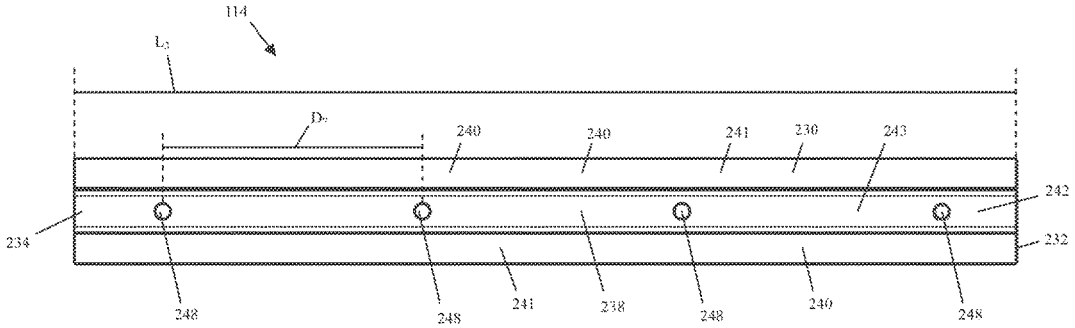
FIG. 10 is a bottom view of the example side weight of FIG. 7.
Figure 11:
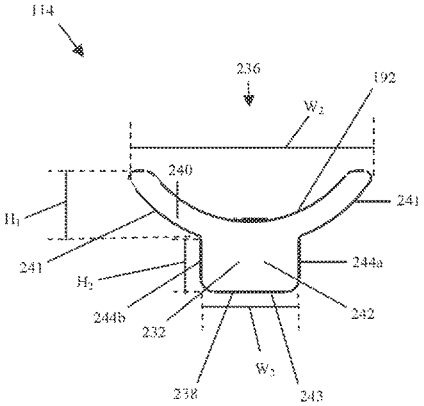
FIG. 11 is a front view of the example side weight of FIG. 7.

FIG. 10 is a bottom view of the example side weight 114 of FIG. 7; FIG. 11 is a front view of the example side weight 114 of FIG. 7. FIGS. 10 and 11 show the example side weight 114 having the interiorly facing curved surface 192, the elongate member 230, the front end 232, the rear end 234, the top 236, the bottom 238, the arcuate portion 240 having a bottom surface 241, the flange 242 having a bottom surface 243, the side surfaces 244*a* and 244*b* and the holes 248, as discussed above.

The example elongate member 230 has a length $L_3$ as measured between the front end 232 and the rear end 234. $L_3$ can be a variety of suitable lengths. In some examples, $L_3$ is in a range from about 25 mm to about 400 mm. In one example embodiment, $L_3$ is about 254 mm.

The arcuate portion 240 has a width $W_2$. $W_2$ can be a variety of suitable widths. In some examples, $W_2$ is in a range from about 15 mm to about 40 mm. In one example embodiment, $W_2$ is about 28 mm. The arcuate portion 240 has a height $H_1$. $H_1$ can be any suitable height. In some examples, $H_1$ is in a range from about 2 mm to about 20 mm. In one example embodiment, $H_1$ is about 8 mm. The flange 242 has a width $W_3$. $W_3$ can be a variety of suitable widths. In some examples, $W_3$ is in a range from about 3 mm to about 20 mm. In one example embodiment, $W_3$ is about 12 mm. The flange 242 has a height $H_2$. $H_2$ can be a variety of suitable heights. In some examples, $H_2$ is in a range from about 2 mm to about 15 mm. In one example embodiment, $H_2$ is about 6 mm. In some examples the sum of $H_1+H_2$ corresponds to the distance between the deepest surface of the side slot 270 (see FIG. 12) of the rail 112 (see FIG. 12) and the exterior surface of a barrel (e.g., the barrel 106 of FIG. 1) that has been inserted in the rail.

The holes 248 can be distributed along the elongate member 230 to match up with corresponding holes in a firearm rail for securing the side weight 114 to the firearm rail. In some example embodiments, the holes 248 are evenly spaced along the elongate member 230. In some example embodiments, the distance $D_7$ between corresponding locations on each pair of adjacent holes of the holes 248 is in a range from about 5 mm to about 300 mm. In one example, the holes 248 are evenly spaced and $D_7$ is about 69 mm.

Figure 12:
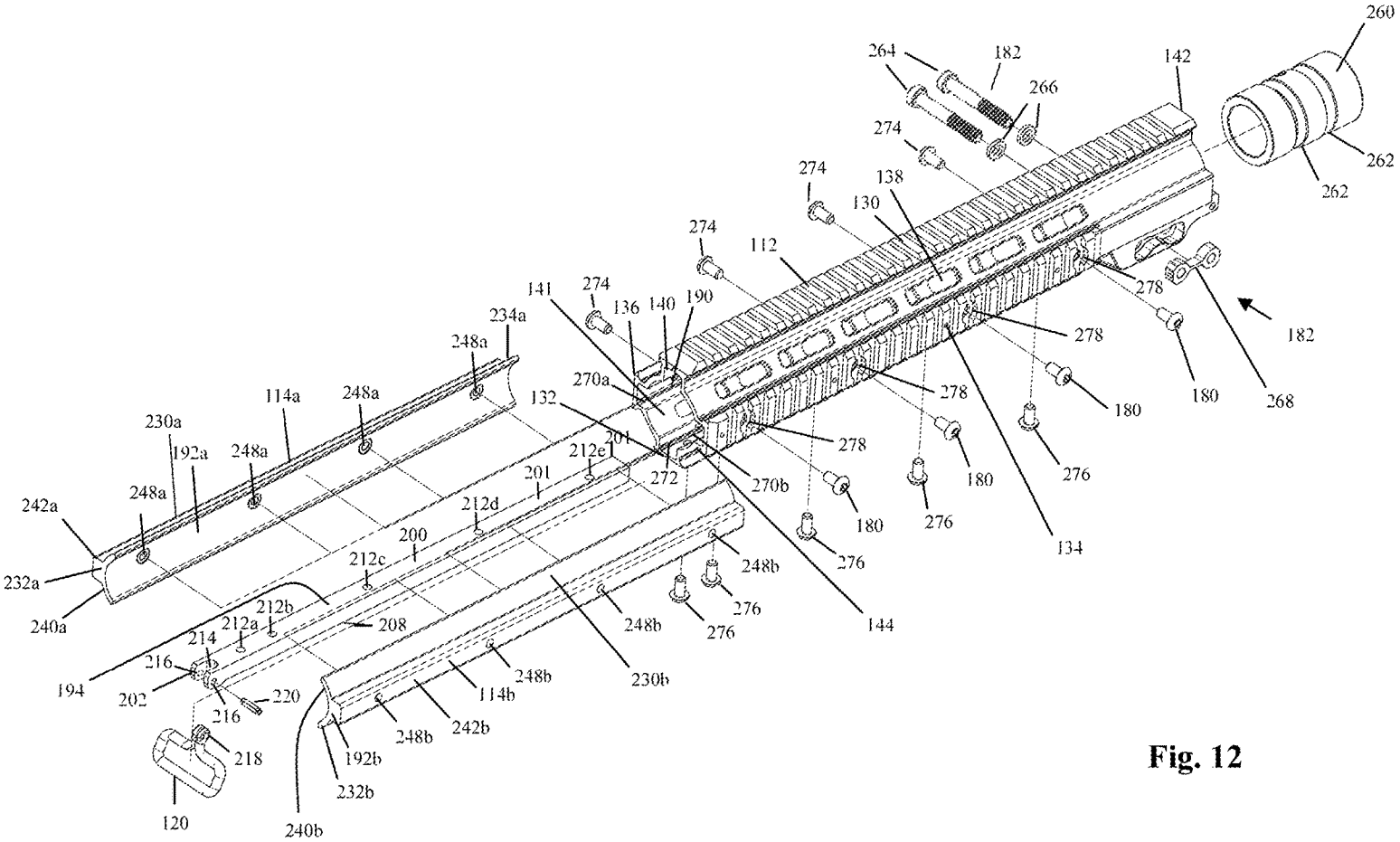
FIG. 12 is an exploded view of a firearm rail in combination with a barrel nut and example side weights and bottom weight with sling loop in accordance with the present disclosure, illustrating how the barrel nut and weights are installed in the firearm rail.

FIG. 12 is an exploded view of a firearm rail 112 in combination with a barrel nut and example side weights and bottom weight with sling loop in accordance with the present disclosure, illustrating how the barrel nut and weights are installed in the firearm rail. The firearm rail 112 includes the top side 130, the bottom side 132, the left side 134, the right side 136, the heat vents 138, the interior surface 140, the interior bore 141, the rear end 142, the front end 144, the side weight fasteners 180, the barrel nut fasteners 182, and the upper channel 190 as discussed above. The bottom weight 116 includes the top surface 194, the elongate member 200, the rear end 201, the front end 202, the bottom surface 208, the screw holes 212*a*, 212*b*, 212*c*, 212*d*, and 212*e*, the cutout 214, and the pin hole 216, as discussed above. The front sling loop 120 includes the sleeve 218, and the pin 220, as discussed above. The side weights 114*a* and 114*b* include, respectively, the interiorly facing curved surfaces 192*a* and 192*b*, the elongate members 230*a* and 230*b*, the front ends 232*a* and 232*b*, the rear ends 234*a* and 234*b*, the arcuate portions 240*a* and 240*b*, the flanges 242*a* and 242*b*, the side surfaces 244*a* and 244*b* and the holes 248*a* and 248*b*, as discussed above. With respect to the side weights 114*a* and 114*b*, all numbered features described above in connection with FIGS. 7-8 correspond to the same reference numbers in FIG. 12, but with the added descriptor "a" or "b" to differentiate between the right and left side weights 114*a* and 114*b*, respectively. In addition, in this example a barrel nut 260 is shown having grooves 262. In addition, in this example the barrel nut fasteners 182 include bolts 264, washers 266 and nuts 268. In addition, in this example the rail 112 includes longitudinally extending side slots 270*a* and 270*b*, a longitudinally extending bottom slot 272, additional side weight fasteners 274, bottom weight fasteners 276, and holes 278.

In some example combinations, the firearm parts shown in FIG. 12 are assembled as follows. The barrel nut 260 is inserted into the rear end 142 of the rail 112. The barrel nut fasteners 182 are installed by inserting the bolts 264 first through the washers 266 and then through the rail 112. As the bolts 264 pass through the rail 112, they engage the grooves 262 of the barrel nut 260, firmly securing the barrel nut 260 relative to the rail 112. When the ends of the bolts 264 exit the rail at the opposing side, they are mated with the nuts 268 to secure the bolts in place.

The side weight 114*a* is installed by inserting the elongate member 230*a* into the side slot 270*a* in the rail 112 until front end 232*a* of the side weight 114*a* is flush with the front end 144 of the rail 112; and such that the interiorly facing curved surface 192*a* faces the interior bore 141 of the rail 112; and such that the arcuate portion 240*a* hugs the interior surface 140 of the rail 112; and such that the flange 242*a* engages the side slot 270*a*. Additional side weight fasteners 274 (which are equivalent to side weight fasteners 180) are inserted through holes in the right side 136 of rail 112, and then inserted through holes 248*a* in the side weight 114*a*, respectively, to secure the side weight 114*a* to the rail 112.

Similarly, the side weight 114*b* is installed by inserting the elongate member 230*b* into the side slot 270*b* in the rail 112 until the front end 232*b* of the side weight 114*b* is flush with the front end 144 of the rail 112; and such that the interiorly facing curved surface 192*b* faces the interior bore 141 of the rail 112; and such that the arcuate portion 240*b* hugs the interior surface 140 of the rail 112; and such that the flange 242*b* engages the side slot 270*b*. The side weight fasteners 180 are inserted through the holes 278 in the left side 134 of the rail 112, and then inserted through the holes 248*b* in the side weight 114*b*, respectively, to secure the side weight 114*b* to the rail 112.

The bottom weight 116 is installed by inserting the rear end 201 of the elongate member 200 into the bottom slot 272 of the rail 112 such that each of the screw holes 212*a*, 212*b*, 212*c*, 212*d*, and 212*e* aligns with a corresponding hole in the bottom side 132 of the rail 112; such that the elongate member 200 engages the bottom slot 272; and such that the cutout 214 extends beyond the front end 144 of the rail 212. The bottom weight fasteners 276 are inserted through holes in the bottom side 132 of the rail 112, and then inserted in screw holes 212*a*, 212*b*, 212*c*, 212*d*, and 212*e*, respectively, to secure the bottom weight 116 to the rail 112. Either before or after the bottom weight 116 is inserted and/or secured to the rail 112, the sleeve 218 of the front sling loop 120 can be coupled to the pin 220, which is in turn coupled to the pin hole 216 in the cutout 214, as discussed above.

The bottom weight 116 and the side weights 114*a* and 114*b* can be removed (and optionally reinstalled) from the rail 112 by removing the various fasteners securing them to the rail, and extracting the weights from the rail.

The various embodiments described above are provided by way of illustration only and should not be construed to limit the claims attached hereto. Those skilled in the art will readily recognize various modifications and changes that may be made without following the example embodiments and applications illustrated and described herein, and without departing from the true spirit and scope of the following claims.

What is claimed is:

1. A firearm rail system, comprising:

a firearm rail comprising an interior bore extending between a front end and a rear end, wherein a barrel of a firearm is receivable through the interior bore with a barrel nut positionable within the interior bore and proximate the rear end, the interior bore comprising an interior surface having at least one longitudinally extending slot, the at least one slot being defined entirely by the interior surface and positioned within the interior bore; and a firearm weight comprising an elongate member having a front end and a rear end, wherein the firearm weight is detachably securable in the at least one slot, wherein when the firearm weight is secured to the firearm rail, the front end of the firearm weight is positioned proximate the front end of the firearm rail and the firearm weight abuts against the interior surface, and wherein the firearm weight comprises a sling loop pivotably attached to the front end of the elongate member.

2. The firearm rail system of claim 1, wherein the weight further comprises a flange that extends from the elongate member and is removably inserted in the at least one slot.

3. The firearm rail system of claim 1, wherein when the firearm barrel is received within the firearm rail, the at least one slot has a depth corresponding to a distance between a deepest surface of the at least one slot and an exterior surface of the firearm barrel.

4. The firearm rail system of claim 3, wherein the weight comprises a thickness corresponding to the depth of the slot.

5. The firearm rail system of claim 1, wherein the front end of the elongate member defines a cutout, and wherein at least a portion of the sling loop is received within the cutout.

6. The firearm rail system of claim 1, wherein the firearm rail comprises at least one hole configured to position the front end of the elongate member such that a cutout protrudes from the firearm rail and the sling loop is pivotable about the front end when the weight is secured in the at least one slot.

7. The firearm rail system of claim 1, wherein the interior surface comprises a curve, and wherein the weight comprises an arcuate portion configured to hug the curve.

8. The firearm rail system of claim 1, wherein the firearm weight is a first firearm weight comprising a sling loop that is pivotably attached to the front end and the at least one longitudinally extending slot is a first slot, and wherein the firearm rail system further comprises:

a second firearm weight comprising an elongate member having a front end and a rear end, and a flange that extends from the elongate member and is configured to be detachably secured to a second slot of the interior surface of the firearm rail; and a third firearm weight comprising an elongate member having a front end and a rear end, and a flange that extends from the elongate member and is configured to be detachably secured to a third slot of the interior surface of the firearm rail.

9. The firearm rail system of claim 8, wherein each of the first firearm weight, the second firearm weight, and the third firearm weight comprises a plurality of holes through which fasteners are removably inserted for securing each of the first firearm weight, the second firearm weight and the third firearm weight to the interior surface of the firearm rail.

10. The firearm rail system of claim 9, wherein the first firearm weight is configured to be detachably secured in the first slot in a bottom of the firearm rail.

11. The firearm rail system of claim 10, wherein the front end of the first firearm weight defines a cutout, and wherein at least a portion of the sling loop is received within the cutout.

12. The firearm rail system of claim 11, wherein at least one of the plurality of holes in the first firearm weight is configured to position the front end of the elongate member such that the cutout protrudes from the firearm rail and the sling loop is pivotable about the front end when the first firearm weight is secured in the first slot.

13. The firearm rail system of claim 10, wherein the flange of the second firearm weight is configured to be detachably secured in the second slot in a side of the firearm rail.

14. The firearm rail system of claim 10, wherein the flange of the second firearm weight is configured to be detachably secured in the second slot in a side of the firearm rail, and wherein the flange of the third firearm weight is configured to be detachably secured in the third slot in an opposite side of the firearm rail.

15. The firearm rail system of claim 8, wherein each of the second firearm weight and the third firearm weight comprises an arcuate portion configured to hug a curved interior side surface of the firearm rail.

16. A firearm comprising the firearm rail system of claim 1.

* * * * *